US006327456B1

(12) United States Patent
Higaya

(10) Patent No.: US 6,327,456 B1
(45) Date of Patent: Dec. 4, 2001

(54) INDUCTION HEATING FIXING DEVICE AND IMAGE FORMING APPARATUS

(75) Inventor: Toshiaki Higaya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/666,462

(22) Filed: Sep. 20, 2000

(30) Foreign Application Priority Data

Sep. 21, 1999 (JP) ..... 11-267278
Aug. 14, 2000 (JP) ..... 12-245703

(51) Int. Cl.[7] ..... G03G 15/20

(52) U.S. Cl. ..... 399/333; 399/328; 399/330; 399/329; 219/619

(58) Field of Search ..... 219/216, 619; 399/122, 328, 329, 330, 333

(56) References Cited

U.S. PATENT DOCUMENTS

Re. 36,124 3/1999 Yokoyama et al. .
5,300,996 4/1994 Yokoyama et al. .
5,426,495 6/1995 Sawamura et al. .
5,594,540 1/1997 Higaya et al. .
5,819,150 * 10/1998 Hayasaki et al. ..... 399/330
5,832,354 11/1998 Kouno et al. .
5,915,147 6/1999 Kouno et al. .
5,970,299 * 10/1999 Sano et al. ..... 399/330

FOREIGN PATENT DOCUMENTS 4-034483 2/1992 (JP) .
4-134387 5/1992 (JP) .
9-160413 6/1997 (JP) .

* cited by examiner

*Primary Examiner*—Arthur T. Grimley
*Assistant Examiner*—Hoang Ngo
(74) *Attorney, Agent, or Firm*—Oblon, Spivak, McClelland, Maier & Neustadt, P.C.

(57) ABSTRACT

The present invention provides a fixing device that excels in thermal conversion efficiency, compared with an induction-type fixing device. In this fixing device, a peripheral surface of a roller facing an induction coil has concavities and convexities with edges. Where the induction coil is inserted into a core bar, the concavities and convexities are formed inside the core bar. Where the induction coil is located outside the roller, the concavities and convexities are formed on the outer periphery of the core bar.

15 Claims, 8 Drawing Sheets

INDUCTION HEATING FIXING DEVICE AND IMAGE FORMING APPARATUS

BACKGROUND OF THE INVENTION

1. Field of the Invention

The present invention relates to a fixing device to be mounted to an image forming apparatus, such as an electrophotographic printer, facsimile machine, or copying machine. More particularly, the present invention relates to a fixing device utilizing an electromagnetic induction heating technique as a fixing technique.

2. Description of the Related Art

A conventional image forming apparatus that uses toner for forming a visible image includes a fixing device that fixes a toner image onto a recording material. Such a fixing device comprises a fixing roller (or a heating roller) for heating and melting a non-fixed toner image, and a pressure roller that presses a recording material against the fixing roller so as to sandwich and transport the recording material with the fixing roller. Conventionally, such a fixing device comprises a halogen lamp as a heater inside the fixing roller. Such a halogen lamp heats the fixing roller to a temperature high enough for toner image fixation.

However, the above heating method utilizing a heater requires a relatively long time to heat the fixing roller to a predetermined temperature, and during the heating, a user cannot use the image forming apparatus and is forced to wait for a long time. Also, since a halogen lamp heater has great heat loss, the energy consumption becomes large in the halogen lamp heating method. Such a problem cannot be overlooked in this time and age of environmental-friendly movement, and there has been an increasing demand for an efficient fixing device with a short rise time.

In view of the above facts, an induction heating fixing device that heats a fixing roller made of a metallic conductor by eddy current caused by electromagnetic wave has been drawing attention, because such a fixing device dramatically shortens the heating time.

FIG. 1 shows the structure of a conventional induction heating fixing device. In this device, an induction coil 1 is inserted into a heating roller 3 that is in pressure-contact with a pressure roller 2. The induction coil 1 is wound around a bobbin 4, so that high-frequency current flows through the induction coil 1 in its axis direction via a lead wire attached at either end. The induction coil 1 is held by brackets attached to side plates (not shown), and thus prevented from rotating. In FIG. 1, the heating roller 3 rotates clockwise, while the pressure roller 2 rotates counterclockwise. A temperature fuse 5 and a thermistor 6 are disposed on the opposite side of the surface of the heating roller 3 from the pressure roller 2.

During the fixing operation, high-frequency current flows through the induction coil 1 via the lead wires, generating a high-frequency magnetic field. This high-frequency magnetic field generates induction eddy current in the heating roller 3 made of a metallic conductor, and the fixing roller generates Joule heat due to skin resistance. As shown in FIG. 1, a recording sheet S having a toner image T1 to be fixed thereon is transported from the right in the direction of the arrow. The recording sheet S is then sandwiched by the heating roller 3 and the pressure roller 2, so that the toner image T1 is fixed by heat and pressure.

In the above structure, a heating coil for induction-heating the heating roller is inserted into the heating roller so as not to hinder the sheet transportation. Here, the heating roller generally has a cylindrical shape, and the inside of the core bar is not processed. A separation layer is formed outside the core bar, but the separation layer is not directly attached to the core bar, because it is normally difficult for a separation layer to adhere to the surface of the core bar. Therefore, a primer layer is employed to help the bonding between the core bar and t he separation layer.

SUMMARY OF THE INVENTION

It is a general object of the present invention to provide a fixing device in which the above-mentioned problems are eliminated.

A more specific object of the present invention is to provide a fixing device that has a higher thermal conversion efficiency than a conventional induction heating fixing device.

The above objects of the present invention are achieved by a fixing device in which the peripheral surface of a roller facing an induction coil has concavities and convexities with edges.

The above objects of the present invention are also achieved by a fixing device in which a roller facing an induction coil has a core bar, the inner periphery of the core bar has concavities and convexities, and the induction coil is inserted into the core bar. The same effects can be obtained in a case where the outer periphery of the core bar has concavities and convexities, and the induction coil is located outside the roller.

The above objects of the present invention are also achieved by a fixing device provided with a fixing belt wound around at least two rollers. In this fixing device, the fixing belt is made of a magnetic material, an induction coil is located in the vicinity of a pressure contact point between the fixing belt and the pressure roller, and a surface of the fixing belt has concavities and convexities with edges.

The concavities and convexities are formed by a blasting process, an etching process, and a melting and spraying process. In the case of the melting and spraying process, the core bar or the fixing belt should be made of a material selected from the group consisting of titanium, titanium alloys, aluminum, aluminum alloys, copper, and copper alloys, each of which has high thermal conductivity. On the other hand, a material to be melted and sprayed onto the core bar or the fixing belt should be a magnetic material such as stainless steel or iron.

It is preferable that an insulating layer made of fluororesin or silicone rubber is formed on the concavities and convexities. It is more preferable that the insulating layer has a thickness of 0.3 mm or greater. It is even more preferable that the insulating layer also serves as a separation layer.

In accordance with the present invention, the concavities and convexities formed on the surface of the roller facing the induction coil or on the surface of the fixing belt gather the eddy current to the edges of the concavities and convexities, so as to efficiently heat the roller. This technique fundamentally differs from the prior art using the conventional halogen heater technique, in which concavities and convexities are formed on the inner periphery of the heating roller so as to increase the heat reception area to obtain a higher heat absorption rate. In this invention, the locations of the concavities and convexities are determined in accordance with the positional relationship between the roller and the induction coil, thereby ensuring highly efficient heating. More specifically, in a case where the induction coil is inserted into the core bar, the concavities and convexities are formed on the inner surface of the core bar, while in a case where the induction coil is located outside the heating roller, the concavities and convexities are formed on the outer surface of the core bar.

By a blasting process, those concavities and convexities can be formed at low cost. By an etching process, the concavities and convexities are uniformly shaped so as to prevent irregular heat distribution. A melting and spraying process allows a wider variety of materials used for the core bar.

A layer made of resin, more particularly of fluororesin or silicone rubber, can serves as an insulator on the surface with the concavities and convexities, by virtue of its electric insulating characteristics. Even if the coil is brought into contact with the concavities and convexities, such an insulating layer will prevent electric leakage.

Other objects and further features of the present invention will become more apparent from the following description taken in conjunction with the accompanying drawings.

DESCRIPTION OF THE PREFERRED EMBODIMENTS

The following is a description of embodiments of the present invention, with reference to the accompanying drawings.

Figure 1:
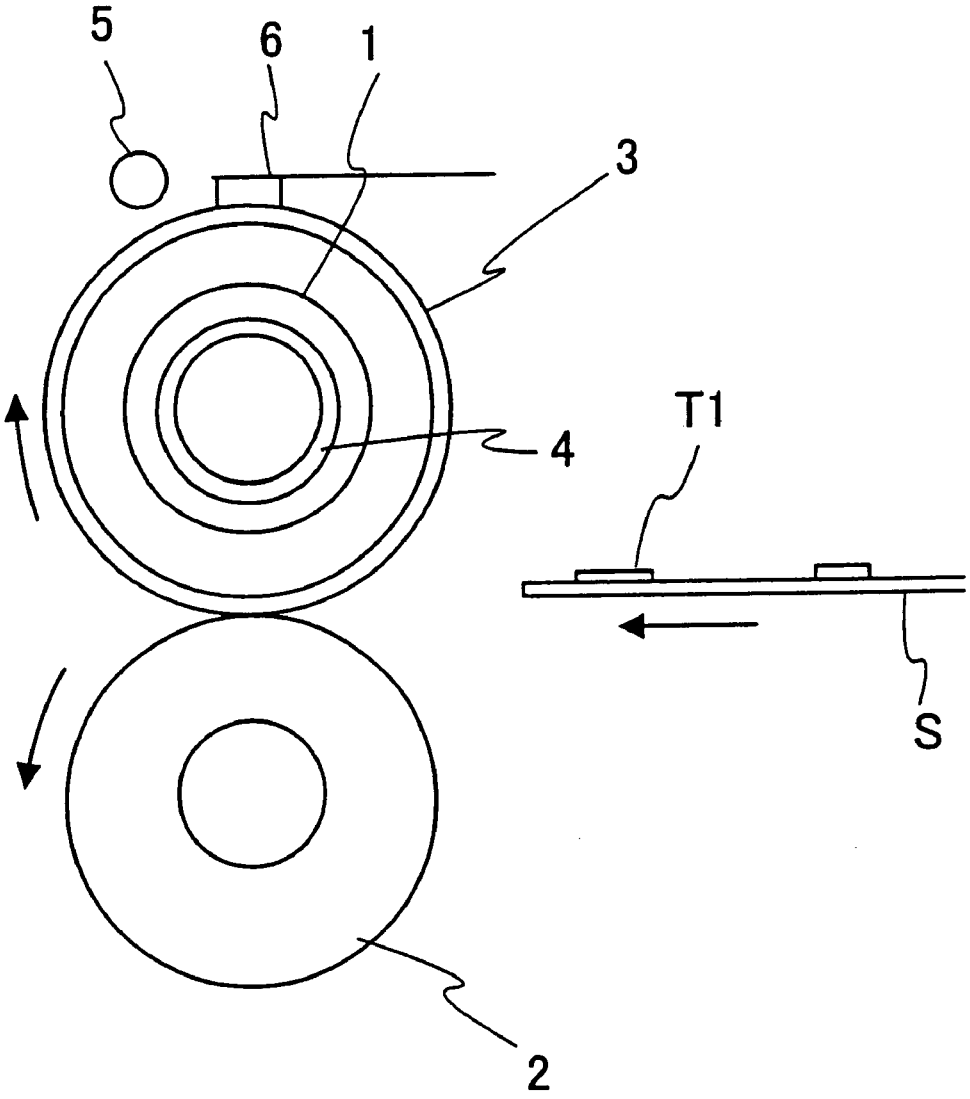
FIG.1 PRIOR ART
FIG. 1 is a schematic view of a fixing device of the prior art.
Figure 2:
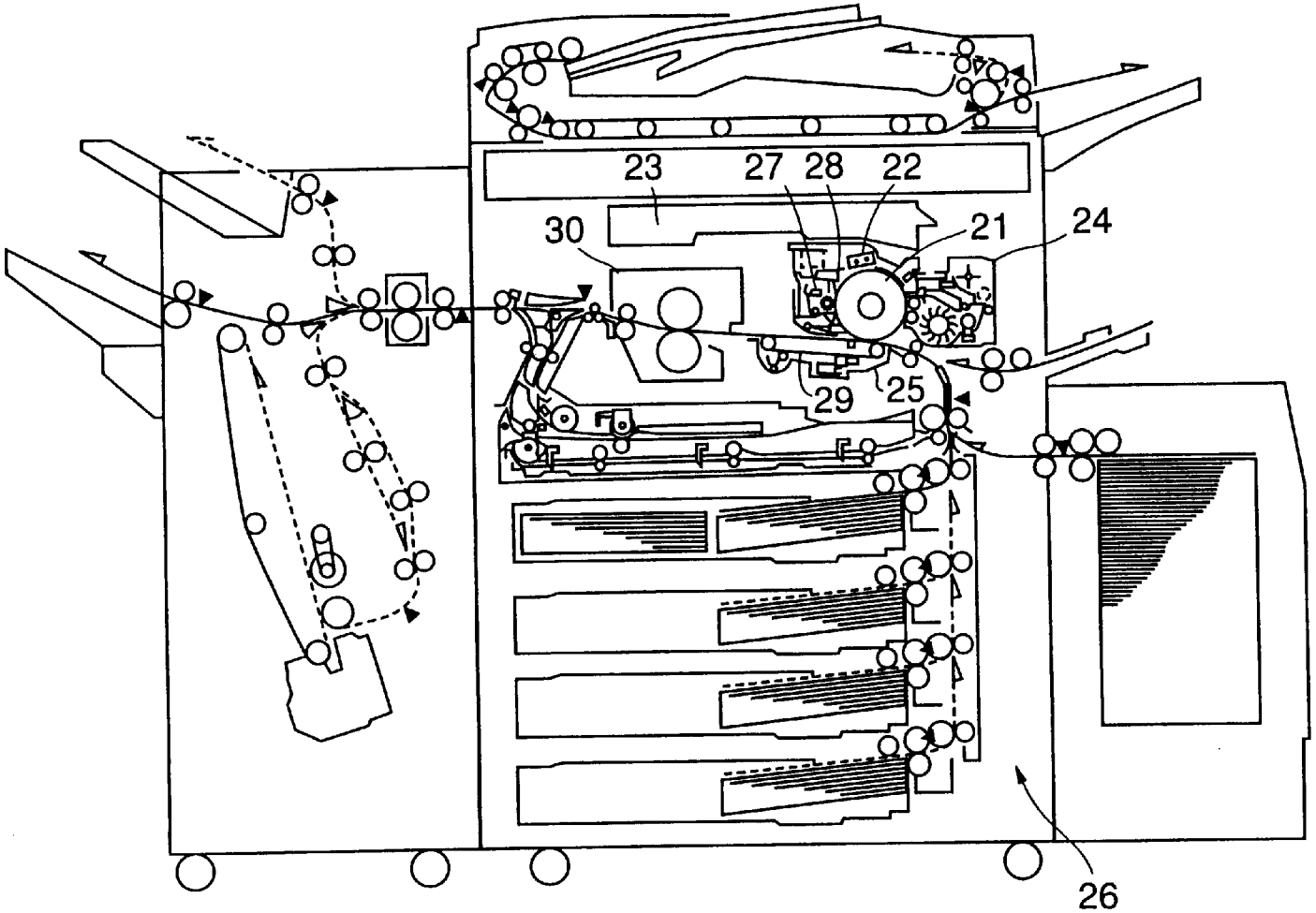
FIG. 2 shows the entire structure of an image forming apparatus in accordance with the present invention.

The entire structure of an image forming apparatus in accordance with the present invention is substantially the same as the structure of a conventional image forming apparatus. In FIG. 2, A photosensitive drum 21 that is an electrostatic latent image carrier is surrounded by a charger 22 for charging the surface of the photosensitive drum 21, a write unit (multi-beam write unit) 23 for forming a latent image on the uniformly charged surface, a developing unit 24 for forming a toner image by attaching charged toner to the latent image formed on the surface of the photosensitive drum 21, a transfer unit (transport belt unit) 25 for transferring the toner image from the surface of the photosensitive drum 21 onto a recording sheet, a cleaning unit 27 for removing residual toner from the surface of the photosensitive drum 21, and a discharging unit (discharging lamp) 28 for removing rest potential from the surface of the photosensitive drum 21. When negative/positive image formation in this structure, the charger 22 uniformly charges the surface of the photosensitive drum 21, and the write unit 23 forms a latent image on the uniformly charged surface. The developing unit 24 then develops a toner image from the latent image. The transfer unit 25, which includes a transfer unit 29, transfers the toner image onto a recording sheet transported from a sheet feeding bank 26 made up of tandem trays, universal trays, and fixed trays, or from an attached sheet feeding tray. At this point, the recording sheet electrostatically adhering to the photosensitive drum 21 is separated from the photosensitive drum 21 by a separation claw. The unfixed toner image on the recording sheet is then fixed onto the recording sheet by a fixing device 30. Meanwhile, the residual toner remaining on the photosensitive drum 21 is removed and collected by the cleaning unit 27. The photosensitive drum 21 is initialized by the discharging unit 28 so as to prepared for a next image forming operation.

Figure 3:
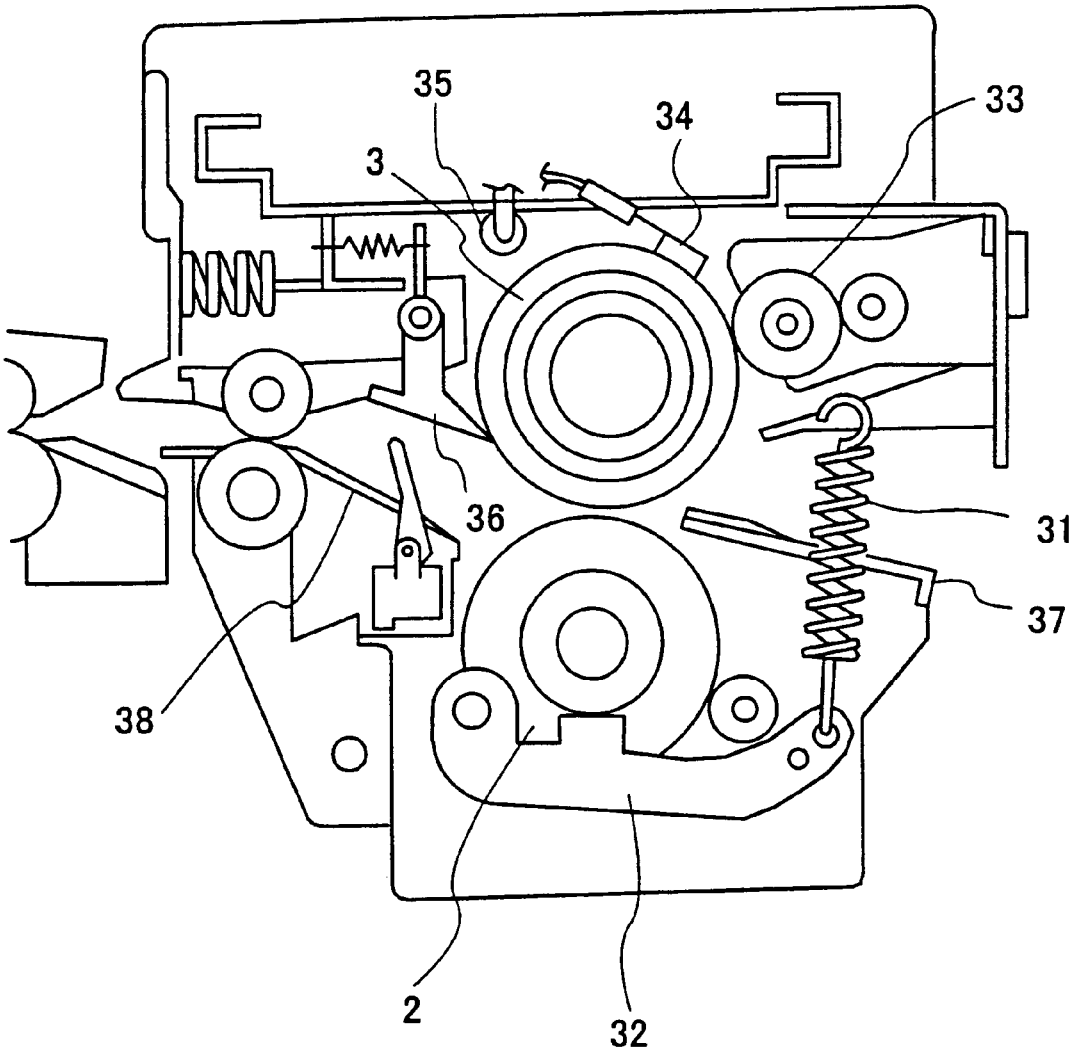
FIG. 3 is a sectional view of a fixing device in accordance with the present invention.

FIG. 3 is a sectional view of the fixing device of the present invention, taken along a surface perpendicular to the roller axis line. A heating roller 3, which is in pressure-contact with a pressure roller 2 by virtue of a pressure spring 31 and a pressure arm 32, rotates clockwise in the figure, so that the heating roller 3 and pressure roller 2 sandwich and transport a recording sheet having a toner image to be fixed thereon toward the left in the figure. The heating roller 3 is surrounded by an oil applying roller 33, a thermistor 34, a temperature fuse 35, and a separation claw 36. An induction coil 1 is inserted into the heating roller 3. Before and after the nip portion between the pressure roller 2 and the heating roller 3, a sheet feeding guide plate 37 that transports a recording sheet having an unfixed image thereon and a sheet discharging guide plate 38 that discharges a recording sheet having a fixed image thereon toward the outside are disposed.

Figure 4:
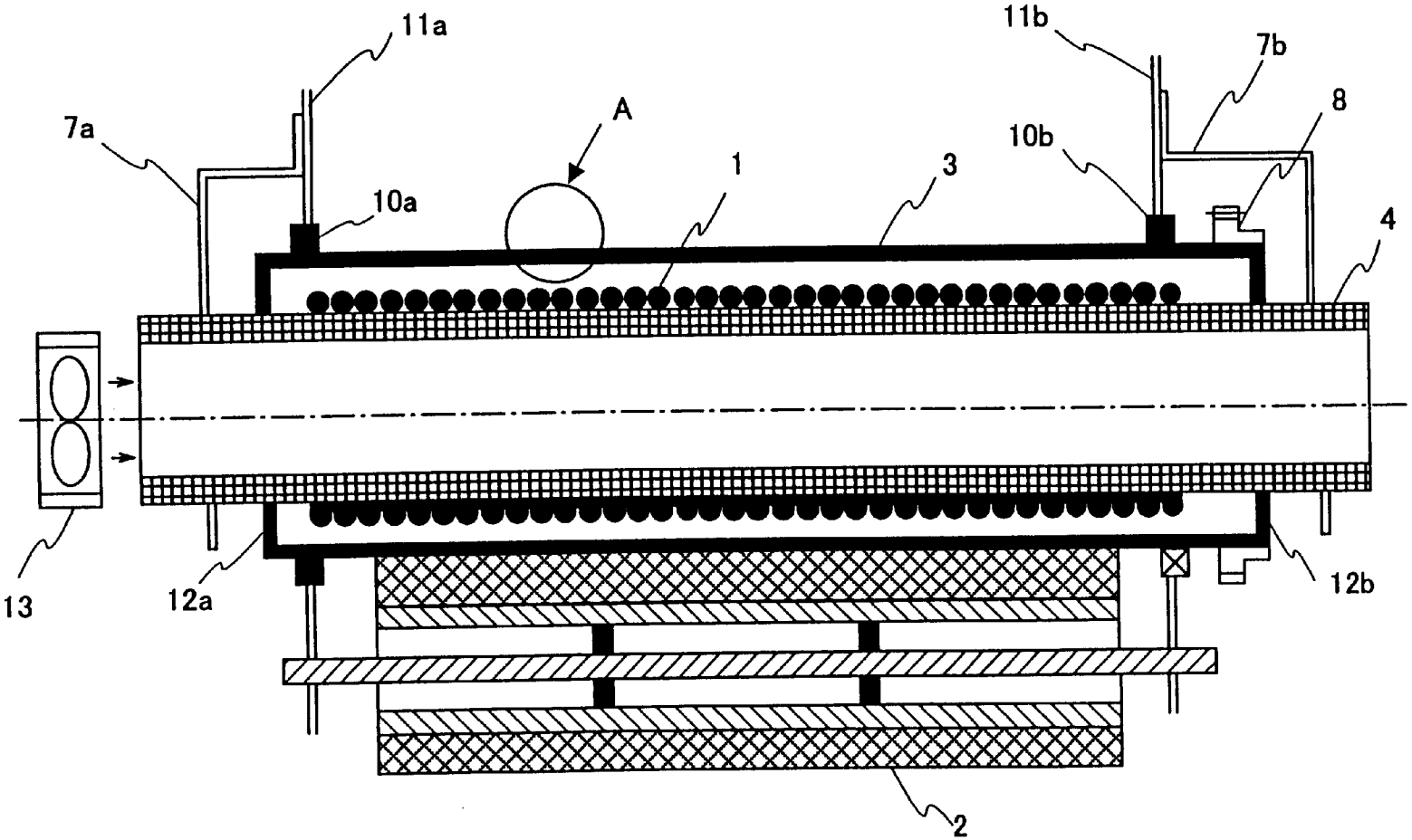
FIG. 4 is a sectional view of an induction coil employed in the fixing device of the present invention.

FIG. 4 is a sectional view of the induction coil of the present invention, taken along its axis line. The induction coil 1 carried by a bobbin 4 is disposed inside the heating roller 3. A gear 8 mounted and fixed to one end of the heating roller 3 supported by bearings 10*a* and 10*b* is engaged with a driving gear (not shown). As the driving gear rotates, the heating roller 3 rotates. The core bar of the heating roller 3 is made of a magnetic material, such as stainless steel or iron, which is covered with a separation layer made of fluororesin or silicone rubber.

The induction coil 1 formed by litz wire or the like is wound around the bobbin 4 made of an insulating material, and provided with a lead wire (not shown) at either end. Through the lead wires, high frequency current flows through the induction coil 1. The bobbin 4 and the induction coil 1 are held by brackets 7*a* and 7*b* disposed on side plates 11*a* and 11*b* of the fixing device 30. Thus, the bobbin 4 and the induction coil 1 are prevented from rotating. Ferrite cores 12*a* and 12*b* are disposed on the surface of the bobbin 4. A cooling fan 13 is disposed at one side of the bobbin 4 in the longitudinal direction. This cooling fan 13 sends cool air into the bobbin 4 so as to cool the induction coil 1 through the bobbin 4.

In an image forming operation, the heating roller 3 starts rotating upon activation of the apparatus. The sheet transportation is then started, and an image is formed on the surface of the photosensitive drum shown in FIG. 2. An unfixed image is then formed on a recording sheet by the transfer unit, and the recording sheet is transported to the fixing device. In the fixing device, the heating roller 3 and the pressure roller 2 sandwich and pressurize the transported recording sheet, thereby carrying out the image fixing.

Figure 5A:
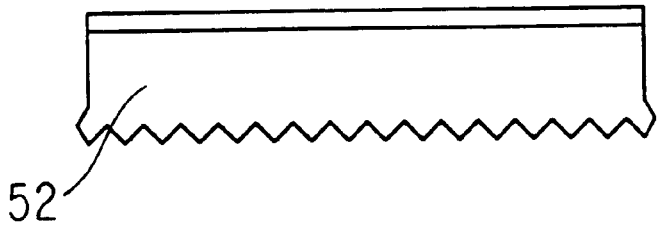
FIGS. 5A to 5C are sectional views of a part of the fixing device of the present invention, taken along its roller axis line.
Figure 5B:
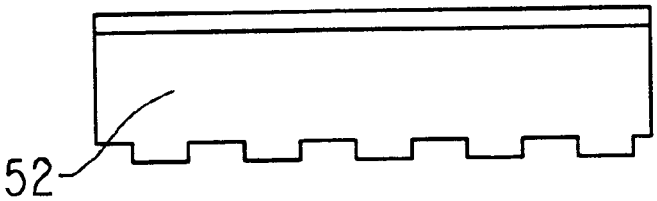
Figure 5C:
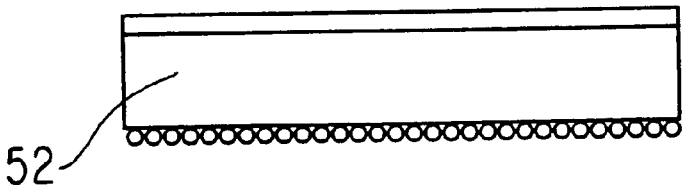

FIGS. 5A to 5C are enlarged views of a portion A of the heating roller 3 shown in FIG. 4. As shown in FIG. 5A, a core bar 52 that surrounds the outer periphery of the induction coil 1 has an inner surface provided with concavities and convexities having edges by sandblasting. As an experiment, a blasting process using Steel Grid MGH-50 was performed on a core bar made of stainless steel having an inner diameter of 49 mm and a thickness of 0.8 mm. When a current was applied to the core bar, the magnetic flux gathered at the edges of the convexities of the inner surface, and the thermal conversion efficiency was 5% higher than the thermal conversion efficiency of a conventional smooth inner surface with the same amount of current applied. More specifically, the thermal conversion efficiency with no blasting process was 59.3%. On the other hand, the heat conversion efficiency with a blasting process was 63.0% with the surface roughness Ra being 1.48 $\mu$m, and 66.3% with the surface roughness Ra being 4.67 $\mu$m.

The same effects as above can be obtained by an etching process shown in FIG. 4B and a thermal spraying process shown in FIG. 4C. The thermal spraying process is a technique of roughening the surface of a core bar by melting and spraying metal powder, and plasma spraying is well known as such a technique. In the plasma spraying, a non-transferred arc is generated by a thermal spraying device, and an inert gas such as Ar, He, $H_2$, or $N_2$ is supplied into the ark, thereby creating a plasma flow. Various particles are sent into the plasma flow, and then melted and sprayed so as to form a coating film. Even a coating film made of a difference metallic material from the core bar can be attached to the surface of the core bar. For instance, a coating made of magnetic particles, such as stainless steel particles having a high heat generating efficiency, can be attached to the surface of a core bar made of a material, such as aluminum, which is excellent in thermal conductivity but poor in heat exchanger effectiveness with the heat generation due to induction heating. In this manner, the melted and attached magnetic particles receive the induced magnetic flux from the facing coil, thereby generating and dispersing heat in the aluminum core bar. Thus, a uniform temperature distribution can be obtained. Also, if a magnetic material such as stainless steel or iron is melted and sprayed onto a core bar made of a material selected form the group of aluminum alloys, titanium, titanium alloys, copper, and copper alloys, the heat generation by the induced heating and the thermal conductivity of the core bar multiply the effect of each other. Thus, higher heat generation efficiency for the heating roller can be achieved, and a uniform temperature distribution can be carried out.

Figure 6:
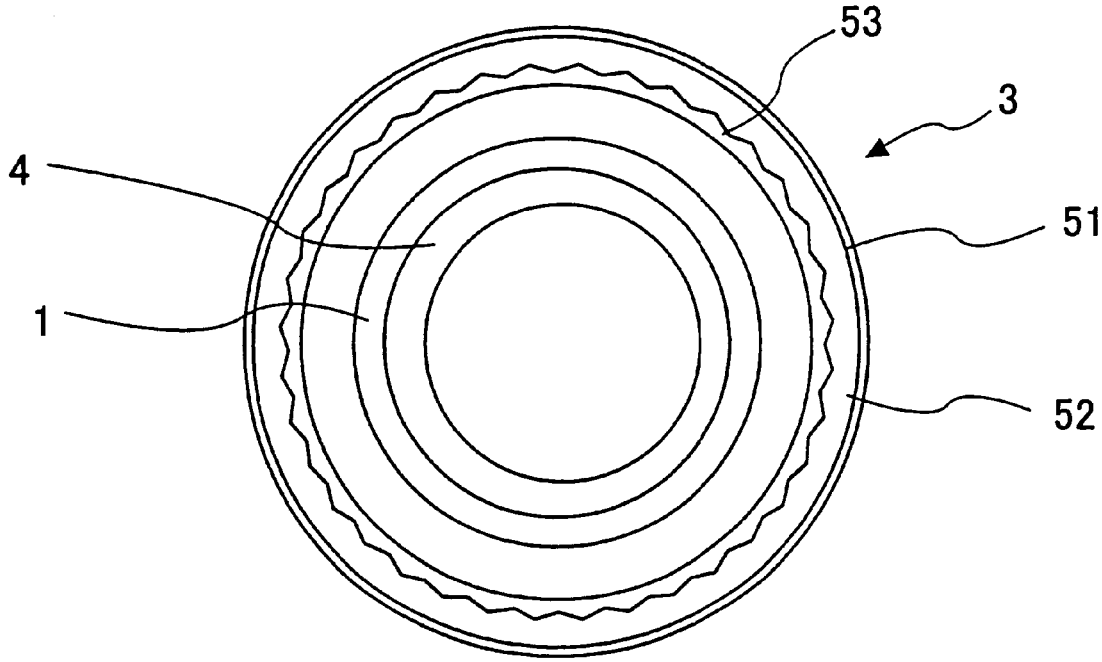
FIG. 6 is a schematic view of a core bar having a separation layer on the surface thereof.

FIG. 6 shows another example of the heating roller 3. This heating roller 3 has a separation layer 51 on the outer periphery thereof. The inner periphery of a core bar 52 facing the induction coil 1 wound around the bobbin 4 has concavities and convexities with edges, and an insulating coating layer 53 covers the concavities and convexities. This insulating coating layer 53 is made of fluororesin, silicone rubber, or fluororubber. The insulating coating layer 53 provides safety, and also serves to prevent oxidation of the core bar. Since line voltage is normally applied to the Induction coil 1, a bare core bar might cause short-circuiting when brought into contact with the induction coil 1. On the other hand, the gap between the core bar of the heating roller 3 and the induction coil 1 should be smaller to efficiently heat the heating roller 3. Therefore, it is preferable to arrange the core bar and the induction coil 1 as closely as possible to each other. The insulating coating layer 53 is then formed to prevent a possibility of short-circuiting and to increase the induction heating efficiency. In this case, the thickness of the insulating coating layer 53 is 0.3 mm or greater, from the viewpoint of safety standards.

Figure 7:
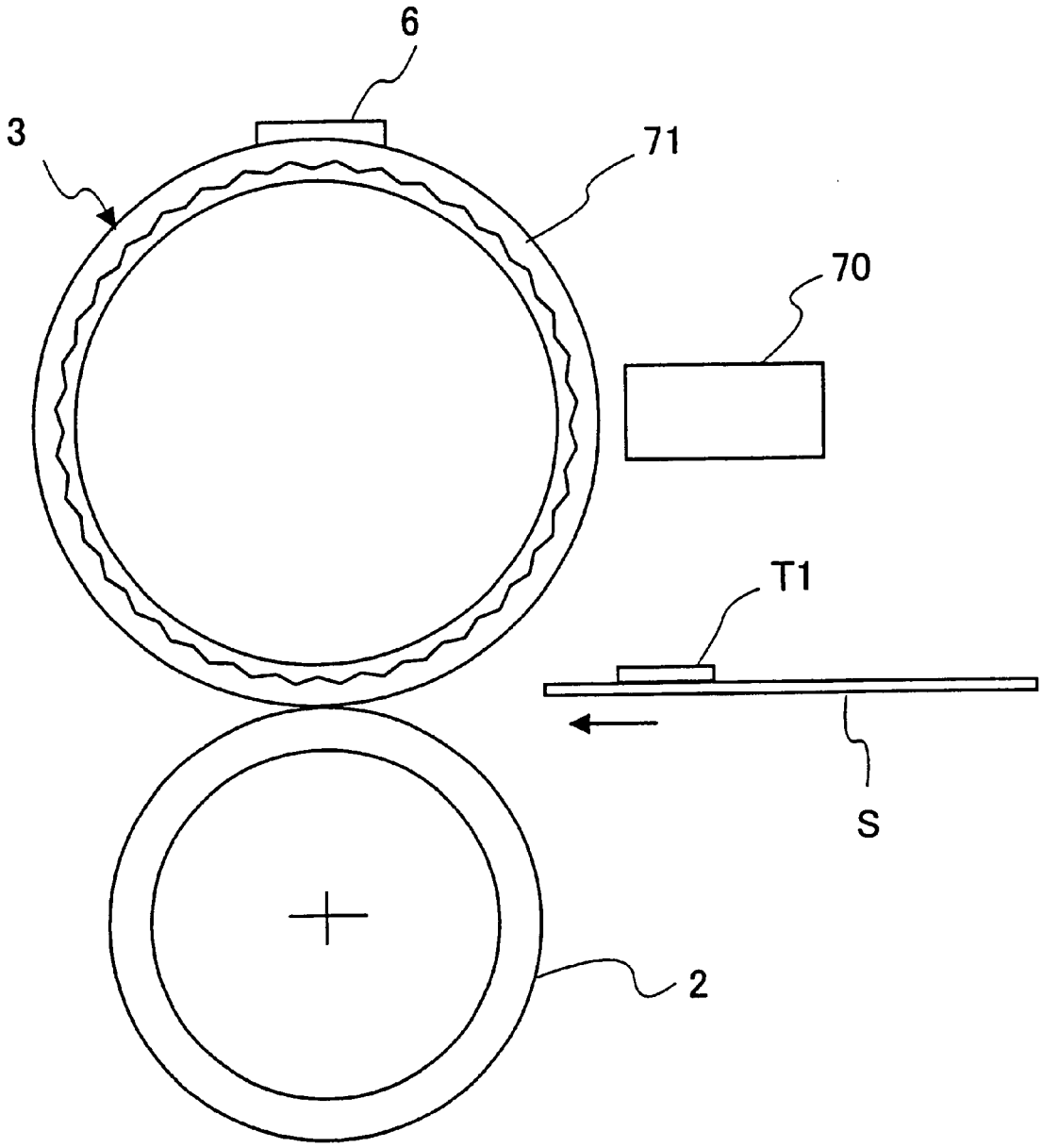
FIG. 7 is a schematic view of a core bar having concavities and convexities on the outer periphery thereof, with an induction coil being located outside the core bar.

FIG. 7 shows another example of the heating roller 3 of the present invention. In this heating roller, an induction coil 70 formed by winding a litz wire around a rectangular ferrite core, for instance, is disposed outside the roller, as shown in FIG. 7, and the outer surface of a core bar 72 is processed to have concavities and convexities by blasting. In this case, a bonding layer (not shown) is provided on the concavities and convexities, and a separation layer 71 is formed on the bonding layer. Like the insulating coating layer 53, the separation layer 71, which also serves as an insulating layer, is made of fluororesin, silicone rubber, or fluororubber, and has a thickness of 0.3 mm or greater. The induction coil 70 is disposed in the vicinity of the separation layer 71, with a distance of 0.5 to 1.5 mm being maintained therebetween. Therefore, a holder of the induction coil 70 is provided with bearings (not shown) to maintain a distance from the heating roller 3. Those bearings are rotatably in contact with the non-feeding portions of the heating roller 3.

Figure 8:
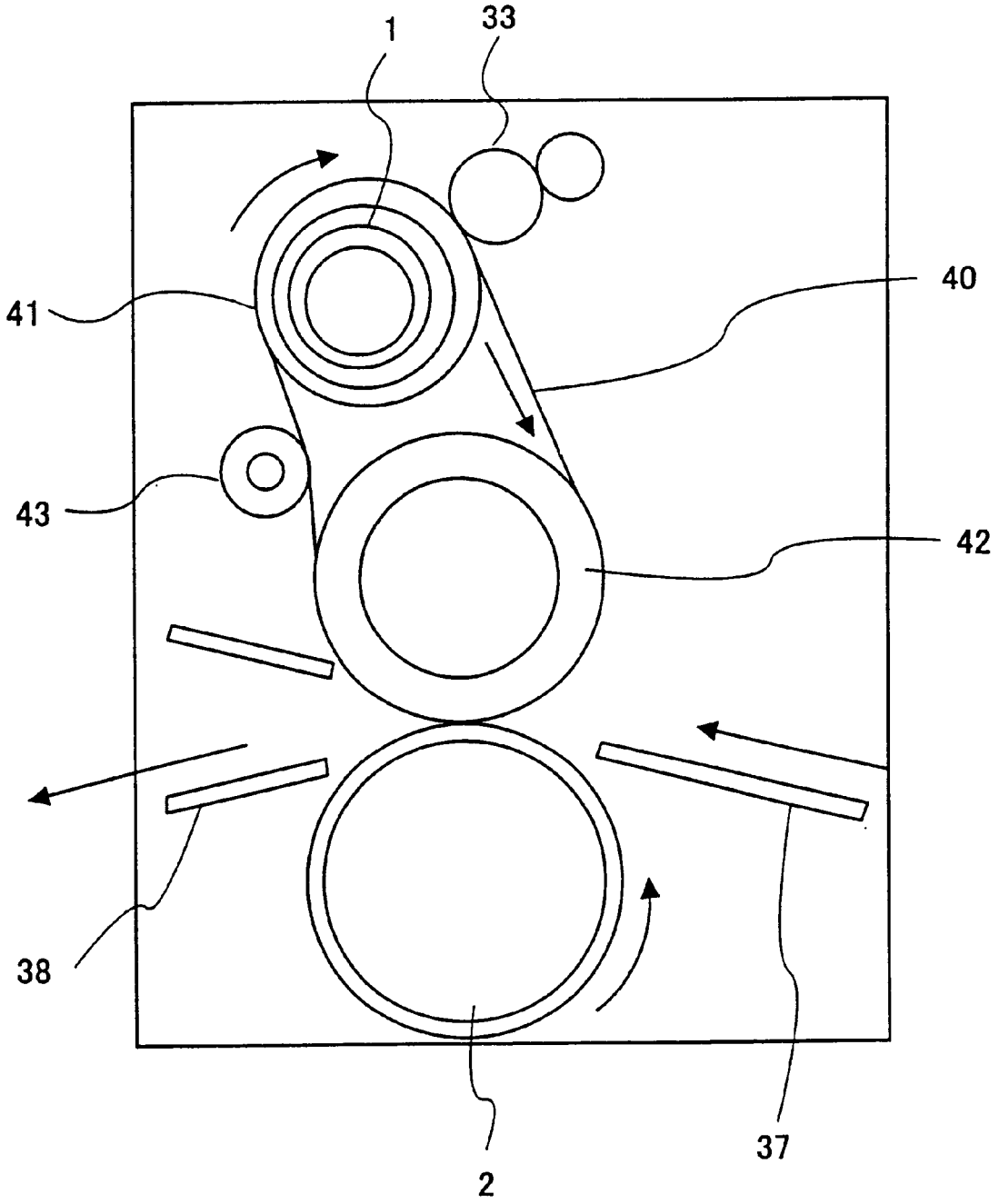
FIG. 8 is a schematic view of a belt fixing type of the fixing device in accordance with the present invention.

FIG. 8 shows an example in which the present invention is applied to a belt fixing device. Of two rollers around which a fixing belt is wound, a roller that is in pressure-contact with the pressure roller 2 so as to sandwich a recording sheet and fixes a toner image onto the recording sheet by pressure and heat is referred to as a fixing roller 42, while the other roller is referred to as a heating roller 41. A fixing belt is wound around the heating roller 41, into which the induction coil 1 is inserted, and the fixing roller 42 in pressure-contact with the pressure roller 2. A tension roller 43 is also employed to provide tension. The inner periphery of the heating roller 41 has concavities and convexities. As in the example shown in FIG. 2, an oil applying roller 33 provided with an oil supply roller is attached to the heating roller 41 via the fixing belt. In FIG. 8, a thermistor and a temperature fuse are omitted for simplification of the drawing. A sheet feeding guide plate 37 for transporting a recording sheet having a non-fixed image thereon is disposed before the nip point between the pressure roller 2 and the fixing roller 42, while a sheet discharging guide plate 38 for discharging a recording sheet having a fixed image thereon is disposed behind the nip point. As a modification of this example, where the fixing belt is wound around two tension rollers, the pressure roller may be in pressure-contact with a part of the fixing belt not in contact with the tension rollers, i.e., the pressure roller may be placed in the position of the tension roller 43 shown in FIG. 8 (including a situation in which the pressure roller is in pressure-contact with one of the two tension rollers via the fixing belt). In this modification, when transporting a recording sheet between the pressure roller and the fixing belt, the induction coil should be disposed on the opposite side of the fixing belt from the pressure roller. The inner periphery of the fixing belt made of a magnetic material preferably has concavities and convexities. It is more preferable to form an insulating layer that covers the concavities and convexities.

The present invention is not limited to the specifically disclosed embodiments, but variations and modifications may be made without departing from the scope of the present invention.

What is claimed is:

1. A fixing device that fixes a toner image onto a recording material by heat and pressure, said fixing device comprising:

two rollers that sandwich and transport the recording material; and an induction coil, wherein at least one of the two rollers is an induction-type heating roller, and a surface of the roller facing the induction coil has concavities and convexities with edges.

2. The fixing device as claimed in claim 1, wherein:

the roller facing the induction coil has a core bar;

the concavities and convexities are formed on an inner periphery of the core bar; and the induction coil is inserted into the core bar.

3. The fixing device as claimed in claim 1, wherein:

the roller facing the induction coil has a core bar;

the concavities and convexities of the roller are formed on an outer periphery of the core bar; and the induction coil is located out side the facing roller.

4. The fixing device as claimed in claim 1, wherein the concavities and convexities are formed by blasting.

5. The fixing device as claimed in claim 1, wherein the concavities and convexities are formed by etching.

6. The fixing device as claimed in claim 1, wherein the concavities and convexities are formed by thermal spraying.

7. The fixing device as claimed in claim 6, wherein:

the core bar is made of a material selected from the group consisting of titanium, titanium alloys, aluminum, aluminum alloys, copper, and copper alloys, each of which has high thermal conductivity; and a material to be melted and sprayed onto the core bar or the fixing belt is made of a magnetic material such as stainless steel or iron.

8. The fixing device as claimed in claim 1, wherein the concavities and convexities are covered with an insulating layer.

9. The fixing device as claimed in claim 8, wherein the insulating layer has a thickness of 0.3 mm or greater.

10. The fixing device as claimed in claim 8, wherein the insulating layer also serves as a separation layer.

11. A fixing device that fixes a toner Image onto a recording material by heat and pressure, said fixing device comprising:

a fixing belt that is wound around at least two winding rollers;

a pressure roller that is in pressure-contact with the fixing belt; and an induction coil, wherein:

the fixing belt and the pressure roller sandwich and transport the recording material;

at least one of the winding rollers is an induction-type heating roller; and a peripheral surface of one of the rollers has concavities and convexities with edges.

12. A fixing device that fixes a toner image onto a recording material by heat and pressure, said fixing device comprising:

a fixing belt that is wound around at least two winding rollers;

a pressure roller that is in pressure-contact with the fixing belt; and an induction coil, wherein:

the fixing belt and the pressure roller sandwich and transport the recording material;

the induction coil is located in the vicinity of the pressure-contact point between the fixing belt and the pressure roller; and a surface of the fixing belt facing the induction coil has concavities and convexities with edges.

13. An image forming apparatus, comprising a fixing device that fixes a toner image onto a recording material by heat and pressure, said fixing device including:

two rollers that sandwich and transport the recording material; and a n induction coil, wherein at least one of the two rollers is an induction-type heating roller, and a surface of the roller facing the induction coil has concavities and convexities with edges.

14. An image forming apparatus comprising a fixing device that fixes a toner image onto a recording material by heat and pressure, said fixing device including:

a fixing belt that is wound around at least two winding rollers;

a pressure roller that is in pressure-contact with the fixing belt; and an induction coil, wherein:

the fixing belt and the pressure roller sandwich and transport the recording material;

at least one of the winding rollers is an induction-type heating roller; and a peripheral surface of one of the rollers has concavities and convexities with edges.

15. An image forming apparatus comprising a fixing device that fixes a toner image onto a recording material by heat and pressure, said fixing device including:

a fixing belt that is wound around at least two winding rollers;

a pressure roller that is in pressure-contact with the fixing belt; and an induction coil, wherein:

the fixing belt and the pressure roller sandwich and transport the recording material;

the induction coil is located in the vicinity of the pressure-contact point between the fixing belt and the pressure roller; and a surface of the fixing belt facing the induction coil has concavities and convexities with edges.

* * * * *